United States Patent [19]

Voegeli

[11] 4,386,691

[45] Jun. 7, 1983

[54] ELECTROMECHANICAL COIN-OPERATED LATCH MECHANISM

[76] Inventor: Ronald C. Voegeli, 918 Gibbs Rd., Venice, Fla. 33595

[21] Appl. No.: 223,137

[22] Filed: Jan. 7, 1981

[51] Int. Cl.[3] ..... G07F 5/16

[52] U.S. Cl. ..... 194/7; 194/1 N

[58] Field of Search ..... 194/1 N, 7, 51, 65, 194/DIG. 3, 10, 59, 1 K, 6; 133/3 C, 3 D, 8 R

[56] References Cited

U.S. PATENT DOCUMENTS

| | | | |
|---|---|---|---|
| 2,603,333 | 7/1952 | Richey | 194/6 |
| 3,067,936 | 12/1962 | Kasper et al. | 194/1 N |
| 3,173,431 | 3/1965 | Chichester et al. | 133/8 R |
| 3,796,294 | 3/1974 | Hoffer et al. | 194/10 |

*Primary Examiner*—Stanley H. Tollberg
*Attorney, Agent, or Firm*—Burns, Doane, Swecker & Mathis

[57] ABSTRACT

An electronically controlled, coin-operated latch mechanism includes an inclined coin chute through which different size coins travel at different angles to provide an electrical connection between different coin detecting contacts. An electronic circuit is responsive to signals generated at the contacts to totalize and store the monetary value of deposited coins. When the stored value equals or exceeds a programmed price, an electromagnet is actuated to enable a hook to be pivoted away from engagement with a latching member. Subsequent movement of the released latching member causes deposited coins to be placed in a coin receptacle and resets the hook for subsequent latching.

19 Claims, 20 Drawing Figures

ELECTROMECHANICAL COIN-OPERATED LATCH MECHANISM

BACKGROUND OF THE INVENTION

The present invention relates to coin-operated latch mechanisms, and more particularly to latch mechanisms of the type in which the total momentary value of deposited coins is electronically calculated and stored, and the latch mechanism is released by electrical means in response to the deposition of a predetermined amount of money. Although not intended to be limited to, the present invention will be particularly described with reference to a newpaper vending machine, wherein the latch mechanism is exposed to varying environmental conditions and rough handling, and is required to operate at a location remote from a readily accessible source of power supply.

In the past, coin-operated latch mechanisms, particularly those adapted for use in outdoor environments, have been of the totally mechanical variety. In such mechanisms, the deposited coins can themselves form part of the latch release structure, such as a camming member, for example. Coin-operated latch mechanisms of this type are illustrated, for example, in U.S. Pat. Nos. 3,760,923 and 3,804,223. Although totally mechanical coin-operated latch mechanisms have operated with a great deal of success in the past, they are subject to certain drawbacks. Most notable among these is the fact that the latch mechanism is capable of being released only by depositing a limited number of coin combinations. More specifically, latch mechanisms of the type illustrated in the above-noted patents operate in response to the height, i.e., diameters, of the deposited coins when edgewise stacked upon one another. When the total height of the deposited coins equals a predetermined value, the coins are engaged by a strategically located pawl mechanism which limits their movement, causing the lowermost coin to function as a camming member that enables the latch mechanism to be released.

Coin mechanisms of this type generally have two separate coin slots, one for dimes and the other for nickels and quarters. This feature is necessary to account for the different thicknesses of these coins. For example, if two dimes are deposited in a single slot thick enough to accommodate a nickel, they could come to rest beside each other, rather than edgewise stacked upon one another, as desired. Only one or the other of the coin slots is normally used during each vending transaction, since the actuation of the mechanism is based upon the sum of the diameters of all deposited coins. However, for certain coin combinations, a specially designed pawl can detect the deposition of a particular coin in each of the two slots and enable the latch mechanism to be actuated.

It will be appreciated that coin-operated latch mechanisms of this type can only be designed to operate with a limited number of coin combinations, less they are to become unduly complex. For example, a newspaper vending machine having a latch mechanism of the type described in the above-mentioned U.S. Pat. No. 3,760,923 patent is capable of vending a 35-cent newspaper with either of the combinations of (a) one quarter and two nickels, or (b) four dimes. A specially designed pawl also provides for actuation of the latch mechanism when one dime and one quarter are deposited. The latch mechanism is not capable of releasing the latch, however, with a deposit of three dimes and one nickel, for example. It is apparent that as the price of a vended commodity increases, the number of possible combinations of coin values equalling the price of the commodity increases at a substantially faster rate. If the latch mechanism is limited, for example, to a total of three possible coin combinations for a particular price, its usefulness in connection with the vending of higher priced items is severely restricted.

Another disadvantage associated with totally mechanical latch mechanisms relates to the ability of the mechanism to accommodate price changes. In the above described mechanisms, price changes are effected by changing the location of the pawls which enable the deposited coins to act as a camming member. Depending upon the type of change to be made, it may be possible to merely shift the location of a pawl within a mechanism without need for further change. However, other types of price changes may require a change in the location, or replacement of, the support structure on which the pawls are mounted. In such a case, the price change is usually effected by removing the entire mechanism and replacing it with a new one. Where a newspaper carrier has a substantial number of vending machines on a route, it will be appreciated that the carrier will be required to transport a substantial number of the new mechanisms with him on the day that the price changes are to be carried out and will have to undergo the time consuming task of replacing the mechanism in each vending machine along the route.

Furthermore, the possible price increments that can be used when carrying out price changes are limited. For example, if the price of a 50-cent article, e.g. Sunday paper, is to be increased, the next available price is 60 cents, which can be obtained with two quarters and two nickels, or with six dimes. It is not possible to choose a price of 55 cents and have the mechanism be totally reliable, since it is conceivable that a combination of coins having a total value less than 55 cents could be used to actuate the mechanism at this price level.

It is therefore a general object of the present invention to provide a novel coin-operated latch mechanism that is capable of being actuated in response to the deposition of any of the various combinations of coins equalling any predetermined price.

It is a further object of the present invention to provide a novel coin-operated latch mechanism which detects the monetary value of each deposited coin and releases the latch mechanism when the total value of deposited coins equals a predetermined price figure.

It is another object of the present invention to provide such a coin-operated latch mechanism in which the total value of deposited coins are electrically stored, and the latch mechanism is electronically actuated when the stored value equals or exceeds the predetermined price.

It is yet a further object of the present invention to provide a novel coin-operated latch mechanism whereby price changes can be effected easily without the need for relocation or replacement of mechanical parts.

It is still another object of the present invention to provide a novel method and apparatus for detecting the size and monetary value of deposited coins.

Coin-operated latch mechanisms having some electronic features are known in the prior art. However, these latch mechanisms are normally located in vending machines that are not subjected to the same conditions as a machine such as a newspaper vending machine. For example, newspaper vending machines that are located outdoors are often subjected to vandalism of the type wherein the machines are turned upside down and battered in an attempt to obtain money and/or newspapers therefrom. Prior art electronic latch mechanisms are usually housed in larger vending machines located indoors and are not subjected to such conditions. Furthermore, since these prior art electronic mechanisms are usually located close to a convenient source of electrical power such as a standard alternating current outlet, the power requirements of such mechanisms are not of concern. However, latch mechanisms which are to be located away from such sources of power supply, and must therefore include a self-contained power supply, should consume as little power as possible in order to reduce the frequency with which the power supply must be replenished or replaced.

It is therefore yet another object of the present invention to provide a novel coin-operated electronic latch mechanism having a substantially rigid structure capable of withstanding adverse handling.

It is still a further object of the present invention to provide a novel coin controlled electronic latch mechanism having minimal power requirements.

BRIEF DESCRIPTION OF THE DRAWINGS

These, as well as other objects and advantages of the present invention, will become apparent to one of ordinary skill in the art to which the invention pertains upon a perusal of the following detailed description in conjunction with the accompanying drawings, wherein:

FIG. 9 is a perspective view of the latch lock,

FIG. 10 is a perspective view of the latch lock spring,

FIG. 11 is a perspective view of the latch hook,

FIG. 12 is a perspective view of the latch hook spring,

FIG. 13 is a perspective view of the latch biasing arm,

FIG. 14 is a perspective view of the door latch tongue, and

FIG. 15 is a perspective view of the distributor door actuator;

DESCRIPTION

As indicated previously, the present invention is described hereinafter with particular reference to a newspaper vending machine. However, it will be appreciated that the invention is not limited to such an application, but is generally applicable to all situations in which a coin-operated latch mechanism is required or desirable, particularly those applications in which the mechanism and its accompanying structure are subjected to adverse handling and/or located away from a convenient source of electrical power.

Figures 1, 16:
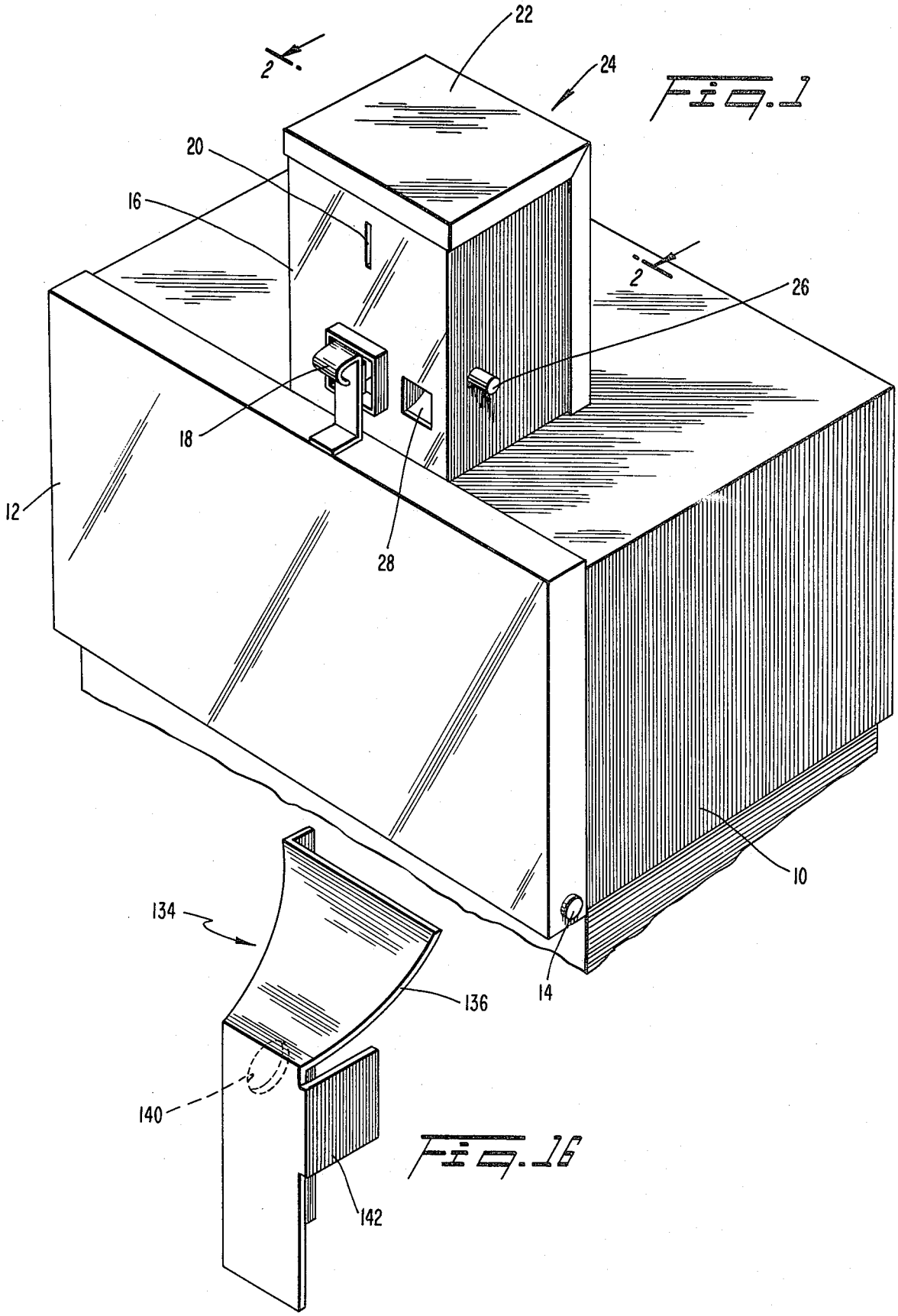
FIG. 1 is a perspective view of the top half of a newspaper vending machine.
FIG. 16 is a perspective view of the coin return cam bracket.

Referring to FIG. 1, a newspaper vending machine generally comprises a box-like article housing 10 forming a compartment in which a plurality of newspapers, magazines or other similar vended products can be stored. One wall of the housing 10 comprises a door 12, connected to the housing by means of a suitable hinge mechanism 14 for enabling the door to be opened to provide access to the interior of the compartment to obtain a newspaper or similar article. The door 12 is preferably transparent, or has a transparent panel therein, to enable a consumer to ascertain that at least one vended article is present within the storage compartment prior to depositing coins in the machine.

A latch mechanism housing and coin receiving box 16 is mounted on top of the vended article housing 10. A suitable handle 18 is attached to the top of the door 12 and, when grasped and pulled in a downward direction, facilitates opening of the door. The handle 18 includes a tongue portion which extends into the latch mechanism housing 16 and is engaged by the latch mechanism therein. The latch mechanism housing 16 includes a removable portion which enables the vendor to gain access to the interior of the housing to remove coins deposited through a coin slot 20, as well as to gain access to the latch mechanism components for repair, inspection, or the like. In the illustrated embodiment, the removable portion of the latch mechanism housing 16 includes the top wall 22 and the rear side wall 24. These two walls preferably form an integral unit which can be locked to the latch mechanism housing 16. The housing 16 also includes a protruding coin return button 26 and a coin return chute opening 28 to enable deposited coins to be returned to the consumer prior to receiving a vended article. Further details of the construction of the latch mechanism housing 16 are disclosed in U.S. Pat. No. 4,135,375.

Figure 2:
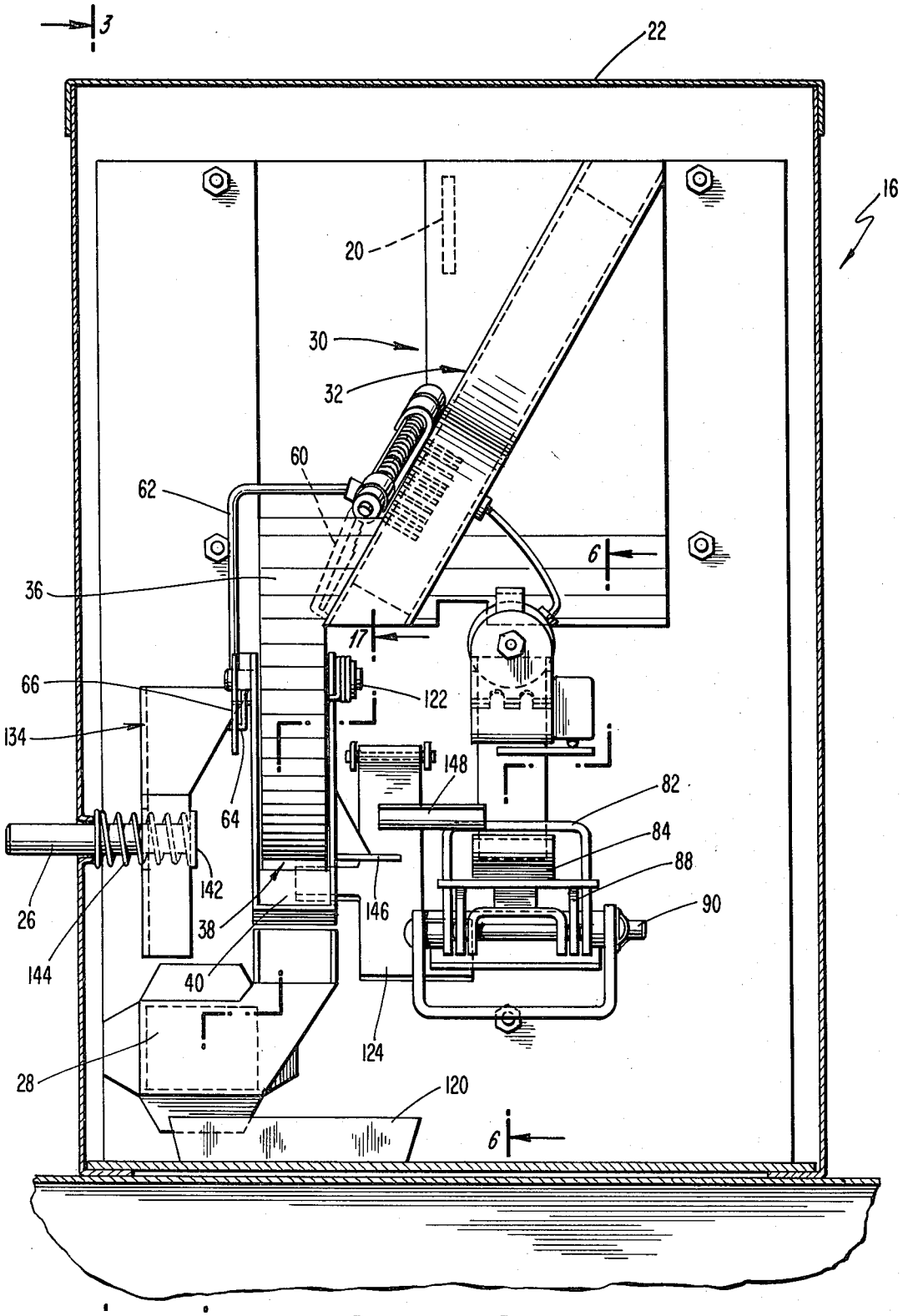
FIG. 2 is a rear view of the latch mechanism housing and a latch mechanism constructed in accordance with the present invention.
Figure 3:
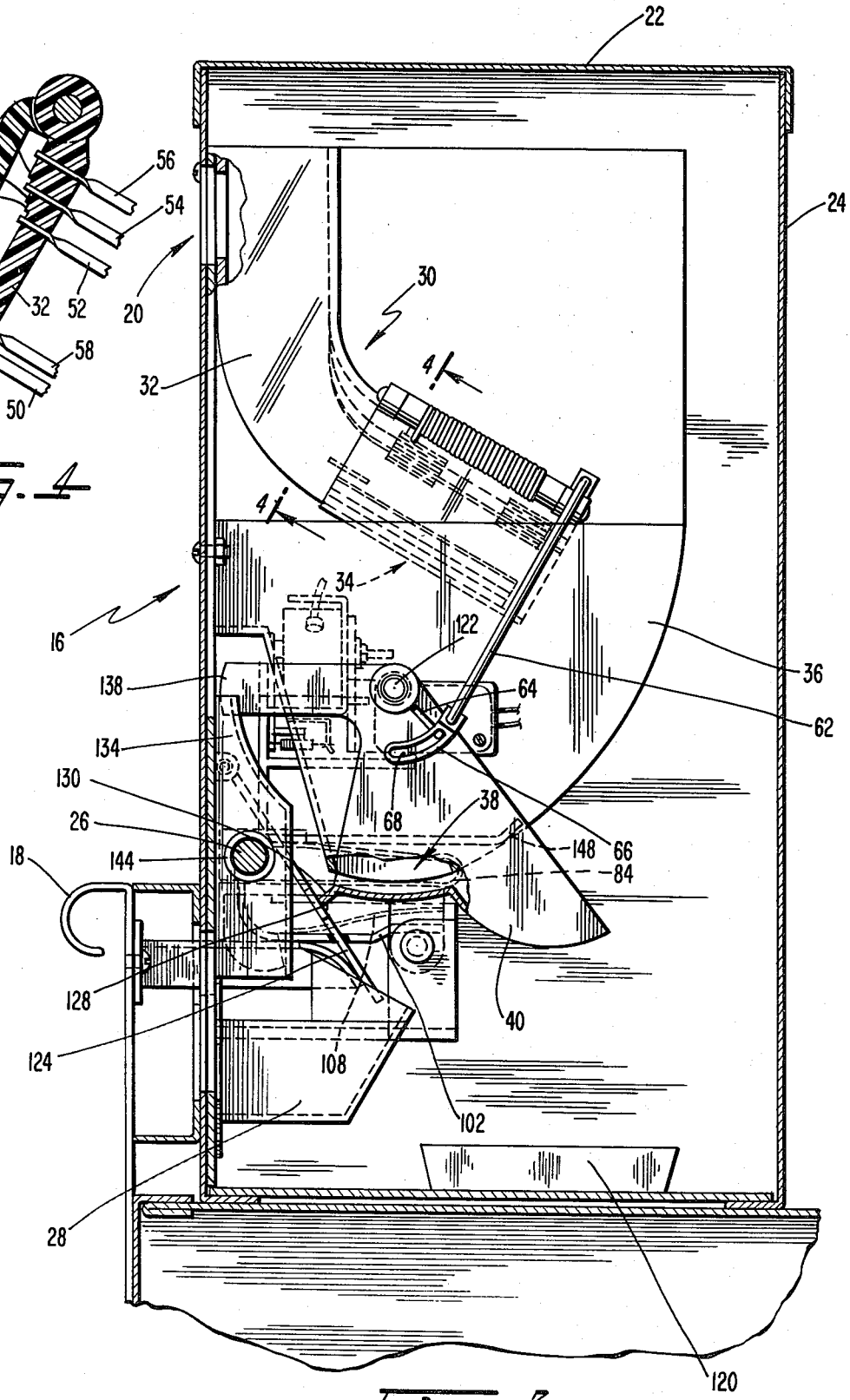
FIG. 3 is a side view of the latch mechanism housing and the latch mechanism taken along the sectional line 3—3 of FIG. 2.

Referring to FIGS. 2 and 3, a rear view and a right side view, respectively, of the latch mechanism are illustrated. A coin chute 30 is located near the top of the housing 16 and receives coins deposited through the coin slot 20. After passing through the slot 20, a deposited coin falls vertically downward until it comes into contact with an inclined side wall 32 of the chute (see FIG. 2). The inclined side wall 32 causes the coin to rest on its side as it continues to travel through the chute. At this point, the chute begins to curve towards the horizontal direction, and the coin passes through a coin detecting section 34 while in the inclined position. In the coin detecting section 34, the monetary value of the deposited coin is electrically detected. After passing through the detecting section, the coin falls into an open-topped, arcuate hopper portion 36 of the chute. The bottom of the hopper 36 has an opening 38, through which the deposited coin falls and comes to rest on the bottom of a slightly arcuate portion of a distributor door 40.

Figure 4:
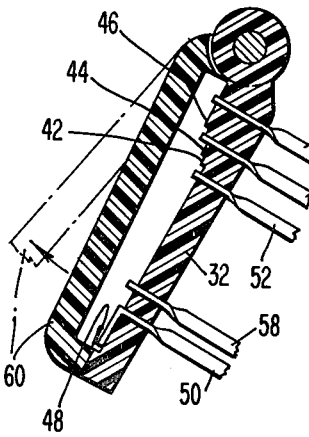
FIG. 4 is a sectional view of the coin chute, taken along the sectional line 4—4 of FIG. 3, illustrating the location of the switch contacts within the chute.

A cross-sectional view of the coin detecting section 34 of the coin chute 30 is illustrated in FIG. 4. The upper portion of the inclined side wall 32 includes a plurality of steps, or shoulders, 42–46 which extend along the length of the inclined wall 32. The steps are located respectively at distances from the bottom wall 48 of the coin chute that are determined in accordance with the diameters of various coins, so that each different type of coin will pass through the coin detecting section 34 at a slightly different angle of inclination. Thus, for example, with reference to coins of U.S. denomination, the distance between the first step 42 and the bottom wall 48 is only slightly greater than the diameter of a dime, so that a deposited dime will lie flat against the surface of the inclined wall 32 as it passes through the coin detecting section. The second step 44 is located a distance from the bottom wall 48 determined according to the diameter of a penny, so that a deposited penny will pass through the coin detecting section at an inclination which is slightly closer to vertical than that at which a deposited dime is disposed. In a similar manner, the remaining steps in the inclined wall 32 are strategically located so that each coin of a successively greater size passes through the coin detecting section at an angle of inclination which is slightly closer to vertical than that of a preceding coin size.

A plurality of coin detecting switch contacts are also disposed on the inclined side wall 32 of the coin chute. These contacts can include a common, or ground, bar contact 50 disposed near the bottom of a chute in a position to be contacted by each coin which passes through the chute regardless of its size. A dime detecting contact 52 is disposed on the inclined wall 32 just below the first step 42 so that it will be contacted by a deposited dime as it passes through the chute 30. The contact 52 protrudes above the surface of the inclined wall 32 an amount less than the depth of the step 42, so that a coin other than a dime passing through the chute will be raised above the surface of the contact by one of the steps 42–46 and will not engage the dime detecting contact 52.

In a similar manner, a nickel detecting contact 54 is disposed on the surface of the second step 44 in a position to be engaged only by deposited nickels, and a quarter detecting contact 56 is disposed on the surface of the top step 46 so as to be engaged by a deposited quarter passing through the chute 30. Each deposited coin, as it passes through the coin detection section 34 of the chute 30, forms an electrical connection between the common contact 50 and one of the coin detecting contacts to generate an electrical signal on the coin detecting contact indicating that a coin of a particular monetary value is passing through the chute.

Although the preferred embodiment of the invention is disclosed as having only three steps on the inclined wall 32 of the coin chute and three coin detecting contacts for respectively detecting the presence of dimes, nickels and quarters in the coin chute, it will be appreciated that the coin chute can be designed with additional steps and additional detecting contacts to detect the deposition of other types of coins, such as half dollars and dollar pieces, for example. Furthermore, although the disclosed embodiment of the invention is illustrated without a coin detecting contact on the surface of the first step 42, since it may not be desirable to count pennies deposited into the machine, an additional contact for detecting such a coin can be incorporated into the coin detecting section.

Figure 5:
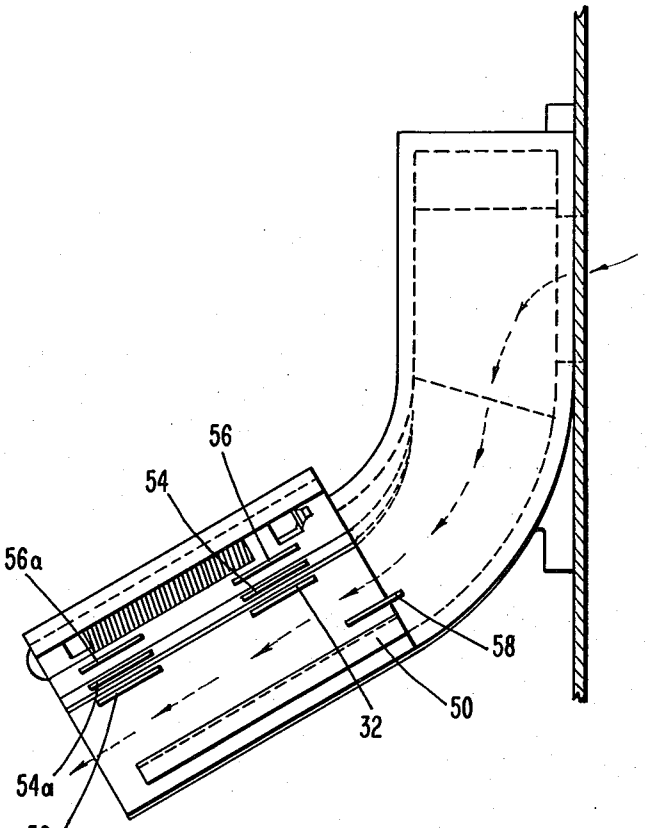
FIG. 5 is a side view of the coin chute with the chute shown in the open position to illustrate the coin contacts.

In addition to the common bar contact 50 and the various coin detecting contacts, an additional indicating contact 58 can be disposed in the coin detecting section 34 near the bottom of the inclined wall 32 so as to be engaged by each coin passing through the coin chute. Thus, the contact 58 will generate an electrical signal for each coin that is deposited in the vending machine, regardless of the size of the coin. This contact is preferably located upstream of the coin detecting contacts 52–56 (as illustrated in FIG. 5), to provide an initial signal when a coin is deposited. For example, this signal can be used to turn on the power to appropriate sections of coin detection circuitry that receives electrical signals from the coin detecting contacts 52–56.

The outer wall 60 of the coin chute 30, opposite the inclined wall 32, is preferably connected to the inclined wall 32 by means of a hinge so as to be pivotable with respect to the wall 32. The pivotable wall 60 is operatively connected to the distributor door 40 by means of a linkage mechanism including a connecting link 62 attached to the wall 60, a pin 64 mounted to move with the distributor door 40, and an arcuate, slotted plate 66 operatively connecting the link 62 to the pin 64. In its normal position, the pin 64 is disposed within the slot 68 of the plate 66 at one end of the slot. When the distributor door 40 is pivoted in a clockwise direction, as viewed in FIG. 3, an angled tip of the pin 64 will slide within the slot 68 and will not affect the link 62. However, if the distributor door 40 should be pivoted in a counter-clockwise direction by actuation of a coin return mechanism, the pin 64 will force the plate 66, and hence the link 62, in a generally upward direction. This movement of the link causes the pivotable wall 60 to pivot away from the stationary inclined wall 32 of the coin chute, as illustrated in the phantom lines in FIG. 4. By pivoting the walls away from each other in this manner, coins which may be trapped in the coin chute, such as bent coins or oversized coins, will fall out of the chute and into the hopper 36.

The configuration of the contacts within the coin detecting section is illustrated in FIG. 5, which is a view of the coin detecting section similar to FIG. 3 but with the pivotable wall 60 pivoted out of the way to permit better viewing of the contacts. The common contact 50 preferably extends along the length of the coin detecting section 34 and is engaged by each coin along the length of its path of travel through that section. The indicator contact 58 is disposed only near the upstream portion of the coin detecting section, to provide a short electrical pulse as each deposited coin enters the coin detecting section.

The various coin detecting contacts 52–56 can respectively comprise first strips of metal located near the upstream portion of the coin detecting section. In addition, each of the coin detecting contacts can include a second strip of metal disposed near the downstream end of the coin detecting section, remote from and insulated from the first strip of metal. With such a contact arrangement, each of the coin detecting switches can function as a single-pole, double-throw switch which provides a first electrical pulse when a coin enters the coin detecting section 34, and a second pulse as the coin leaves the detecting section, to provide an indication that a coin of a particular monetary value has passed through the chute. This single-pole, double-throw switch action can also be utilized by appropriate debounce circuitry to prevent erroneous, e.g. duplicate, detection of coins.

Figure 7:
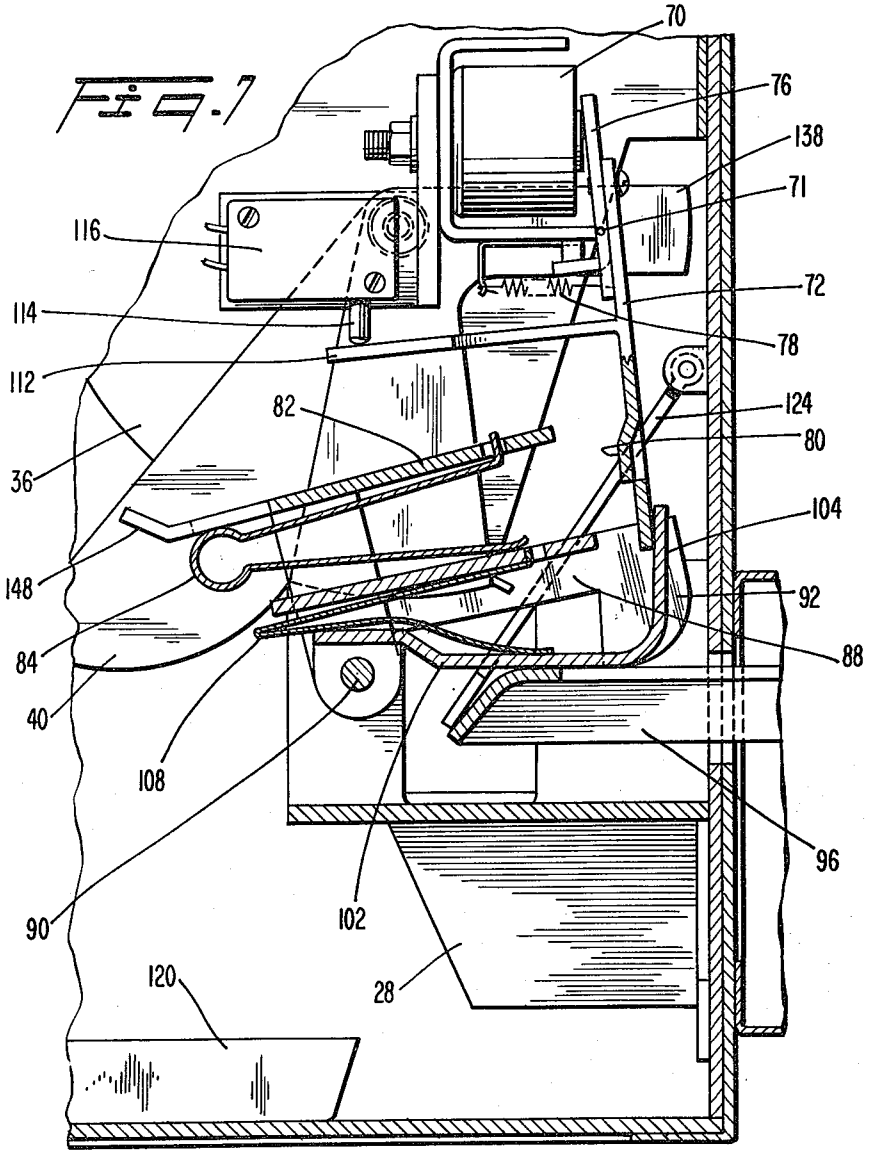
FIG. 7 is a side view similar to FIG. 6 illustrating the latching assembly in the unlatched position while the door of the newspaper vending machine is closed.
Figure 6:
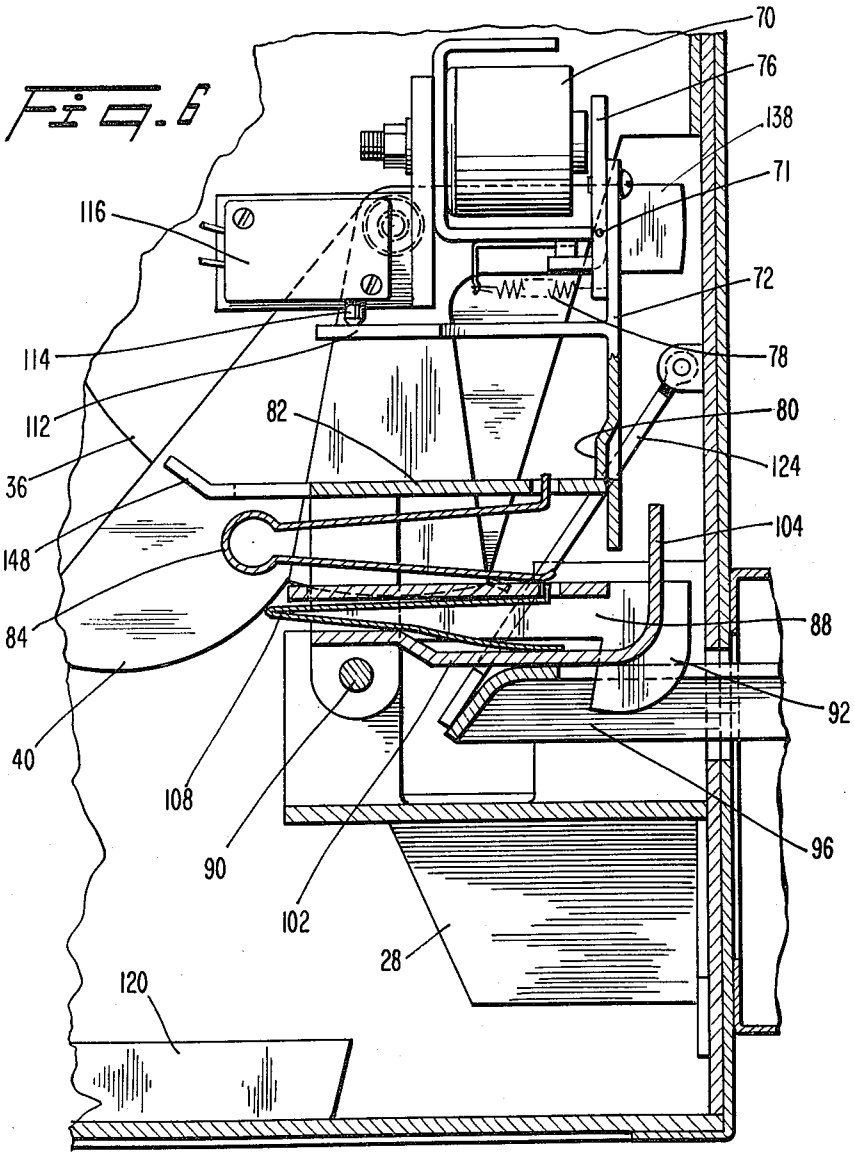
FIG. 6 is a side view, taken along the sectional line 6—6 of FIG. 2, illustrating the latching assembly in the latched position.
Figure 8:
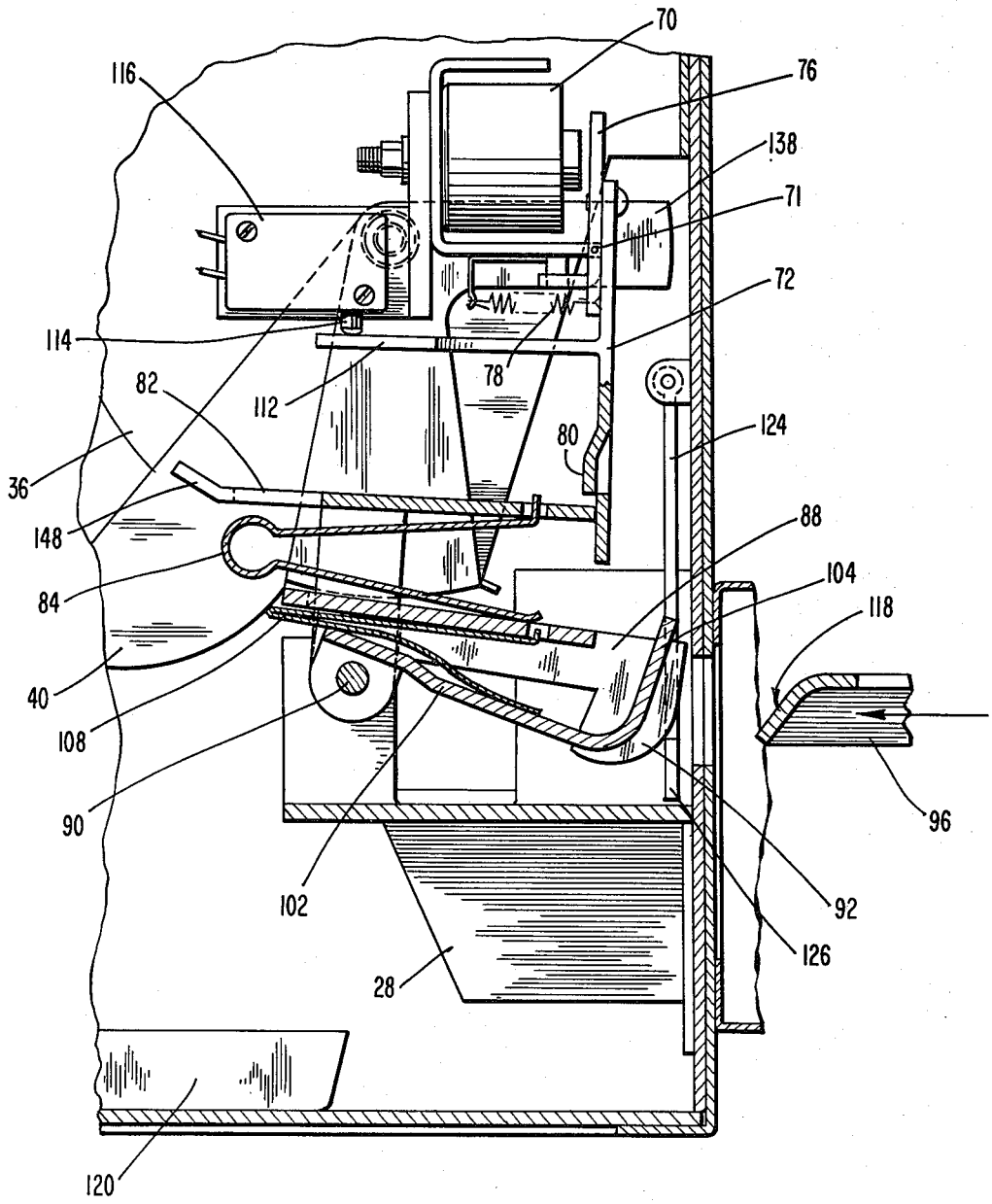
FIG. 8 is a side view similar to FIGS. 6 and 7 illustrating the latching assembly in the latch reset position with the door open.
Figures 9, 10, 11, 12, 13, 14, 15:
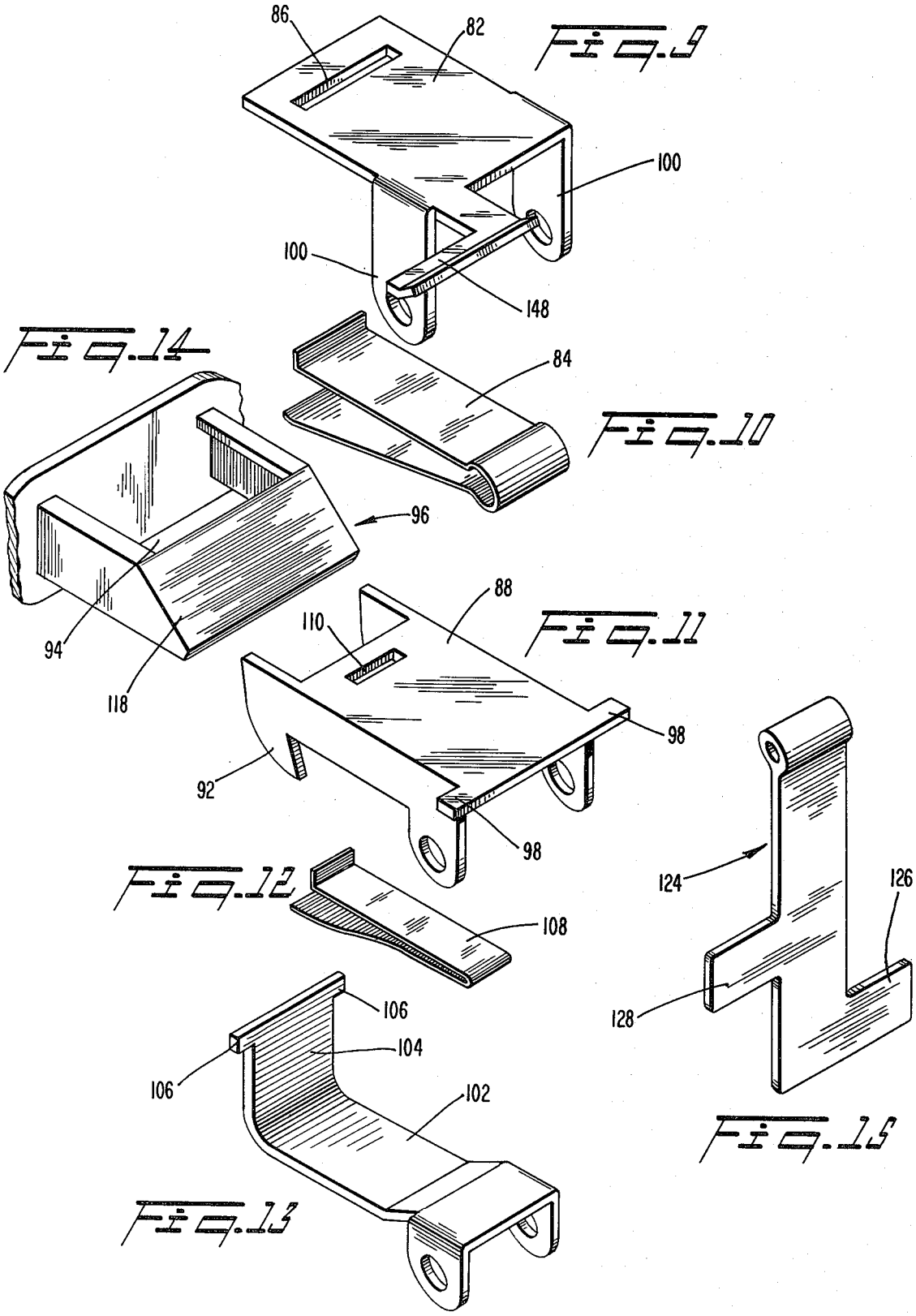
FIGS. 9-15 comprise an exploded view of the latching assembly, and more specifically.

Referring to FIGS. 6–8, which are views of the latch mechanism from the left side, and FIGS. 9–15 which together comprise an exploded view of the components of the latch assembly, further details of the latch mechanism, and its operation, will be described. When the total monetary value of deposited coins passing through the coin chute 30 equals or exceeds the price of the product to be vended, appropriate circuitry responsive to the coin detecting switches generates an electrical signal to energize an electromagnet 70. An actuator bar 72 is mounted to pivot about an axis defined by a pin 74, or the like, and includes a plate 76 mounted at one end thereof adjacent to the electromagnet 70. A spring 78 normally urges the actuator bar 72 to a position in which the plate 76 is spaced from the electromagnet.

Near the end of the bar 72 remote from the plate 76, an offset portion 80 of the bar forms a shoulder against which one end of a pivotally mounted latch lock 82 abuts. The latch lock 82 is urged into abutting engagement with the shoulder 80 by means of a spring 84. One end of the spring 84 is engaged within a slot 86 in the latch lock, and the other end of the spring rests on the top surface of a latch hook 88. The latch hook is pivotally mounted at one end thereof about a pin 90 which also defines the pivot axis of the latch lock 82. The other end of the latch hook 88 includes a downwardly extending projection 92 forming the hook portion thereof. The projection 92 of the latch hook 88 normally lies within an aperture 94 in a tongue 96 attached to the handle 18 of the vending machine door 12. Thus, when the latch lock 82 abuts the shoulder 80 on the actuator bar 72, the spring 84 urges the latch hook 88 into engagement with the tongue 96 to prevent movement of the tongue to the right, as viewed in FIG. 6, thereby preventing the door of the vending machine from being opened. A pair of flanges 98 (FIG. 11) are disposed on the latch hook 88 rearwardly of a pair of downwardly depending legs 100 on the latch lock 82, and are adapted to engage the legs 100 when the latch lock 82 has rotated a predetermined amount in the counterclockwise direction (as viewed in FIGS. 6–8) relative to the latch hook 88.

A ramp pad, or biasing arm, 102 is also mounted for pivotal movement about the pin 90, and includes a horizontal portion which rests upon the upper surface of the tongue 96. The arm 102 also includes a substantially vertical portion 104 at its end remote from the pivotal mounting, which portion is disposed in a space between the projections 92 on the latch hook 88. A flange 106 is located at the top of the vertical portion 104 on each side thereof. The flanges 106 are adapted to engage the top surface of the latch hook 88 when the hook rotates in a counterclockwise direction relative to the biasing arm 102. The bias necessary to produce this rotational movement is provided by a biasing spring 108 located between the latch hook 88 and the biasing arm 102. One end of the spring 108 is disposed in an aperture 110 in the latch hook 88, and the other end of the spring lies on the surface of the horizontal portion of the biasing arm 102, and the spring urges the two members to rotate away from one another.

When the electromagnet 70 is energized, it attracts the plate 76 on the actuator bar 72, causing the bar to pivot to the position illustrated in FIG. 7. The pivoting of the bar in this manner disengages the shoulder 80 from the latch lock 82, freeing the latch lock to pivot in a counterclockwise direction, as viewed in FIGS. 6 and 7, under the force of the spring 84, thereby releasing the biasing force urging the latch hook in a downward direction. As the latch lock 82 continues to pivot in the counterclockwise direction, its legs 100 engage the flanges 98 on the latch hook, thereby preventing further rotation of the latch lock 82 relative to the latch hook 88, while at the same time releasing the downward force exerted by the biasing spring 84 on the latch hook 88.

The force exerted by the spring 108 causes the latch hook 88 to rotate in a counterclockwise direction relative to the biasing arm 102. The latch hook 88 pivots by an amount sufficient to lift the projections 92 out of the aperture 94 in the tongue 96. Once the upper surface of the latch hook 88 engages the projecting flanges 106 on the biasing arm 102, further rotation of the latch hook relative to the biasing arm ceases. At this point in time, illustrated in FIG. 7, the tongue 96 is free to move to the right, enabling the door of the vending machine to be opened and the consumer to obtain a vended product.

The actuator bar 72 includes a generally horizontally disposed arm 112. The end of the arm 112 remote from the bar 72 engages the actuator 114 of a microswitch 116. The microswitch 116 acts as a reset switch to reset any monetary value counters, or similar such storage devices of the electronic circuitry, to zero once the electromagnet has been actuated. The microswitch 116 can also be used to control the supply of power to the electromagnet 70. Therefore, once the actuator bar 72 has pivoted by an amount sufficient to release the latch lock 82, the microswitch 116 can be opened by the arm 112 of the actuator bar 72 to thereby reset the counters and terminate the supply of current to the electromagnet. With such an arrangement, electrical power is conserved, since current is supplied to the power consuming electromagnet for only that length of time necessary for the actuator bar 72 to release the latch lock 82. Once the latch lock and latch hook have been released, the actuator bar 72 can be returned to the position illustrated in FIG. 6 without further interfering with the operation of the latch mechanism.

When the door of the vending machine is opened, and the tongue 96 is removed from the interior of the latch mechanism housing 16, the biasing arm 102 no longer rests upon the surface of the tongue. Therefore, the biasing arm 102, the latch hook 88, and the latch lock 82, which now pivot as an integral unit, fall, i.e., pivot in a clockwise direction, until the biasing arm 102 engages an appropriately positioned stop member (not shown). The position of the components of the latch mechanism when the tongue 96 is removed from the interior of the housing 16 is illustrated in FIG. 8. By this clockwise rotation of the latch mechanism components as the tongue is removed from the housing, the latch lock 82 is again placed in a position to engage the shoulder 80 on the actuating arm 72.

The leading end of the tongue 96 includes an inclined face 118 which forms a cam surface. As the door of the vending machine is closed, the tongue 96 reenters the housing 16 and the cam surface 118 on the tongue engages the biasing arm 102 and arcuate portions of the projections 92 on the latch hook 88. The cam surface 118 forces the biasing arm 102 and the latch hook 88 to rotate in a counterclockwise direction, urging the end of the latch lock 82 into abutting engagement with the shoulder 80 on the actuator arm 72, and compressing the biasing springs 84 and 108. Once the tongue 96 enters the housing a predetermined amount, the projections 92 on the latch hook 88 enter the aperture 94 in the tongue under the force of the biasing spring 84. At this point, the mechanism is latched and its components occupy the positions illustrated in FIG. 6.

Figure 17:
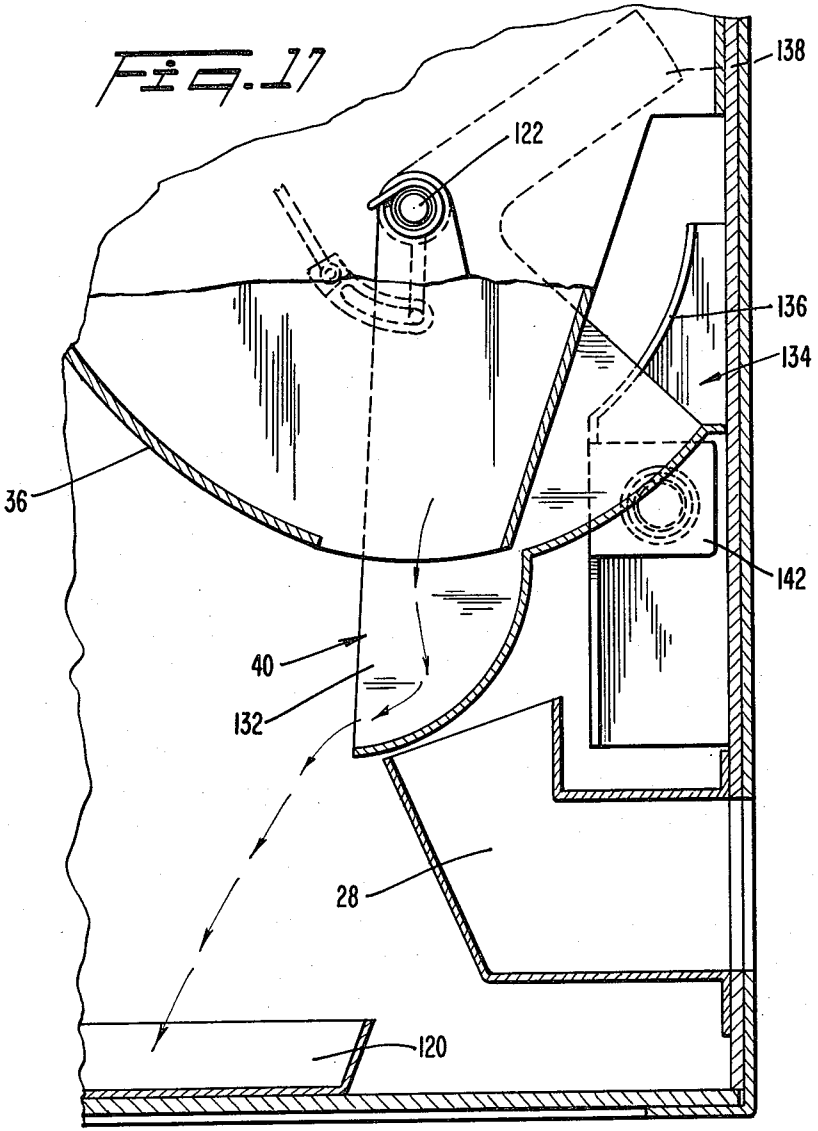
FIG. 17 is a sectional side view, taken along the sectional line 17—17 of FIG. 2, illustrating the coin distributor door in the open position to deposit coins in a coin tray after the door of the vending machine has been opened.

The removal of the tongue 96 from the interior of the latch mechanism housing 16 during opening of the vending machine door also results in the placement of deposited coins in a coin tray 120 located in the bottom of the housing 16. As discussed previously, deposited coins which have passed through the coin chute 30 and been detected come to rest on a slightly arcuate portion of the distributor door 40. The distributor door is pivotally mounted on a pin 122 and biased, by means of a suitable coil spring for example, to rotate in a clockwise direction as viewed in FIG. 3. Rotation of the door is prevented, however, by a distributor door actuator arm 124, illustrated in detail in FIG. 15. The arm 124 is pivotally mounted at one end thereof to the front wall of the latch mechanism housing 16. A flange 126 projects from one side of the arm at the other end thereof, and rests upon the cam surface 118 of the tongue 96 when the door of the vending machine is closed, as illustrated in FIGS. 3, 6, and 7. A second flange 128 disposed approximately centrally of the arm 124 projects from the other side thereof, and engages a projection 130 on the distributor door 40, inhibiting clockwise rotation of the door as viewed in FIG. 3. When the door of the vending machine is opened, the actuator arm 124 pivots with movement of the tongue 96 until it comes to rest approximately parallel with the wall of the housing 16, as illustrated in FIG. 8. Along with movement of the actuator arm, the distributor door 40 pivots under the influence of its biasing spring, to a position illustrated in FIG. 17. In this position, the deposited coins which had been resting on the bottom of the door will fall into a curved spout-like portion 132 of the distributor door, which directs the coins into the tray 120.

Figure 18:
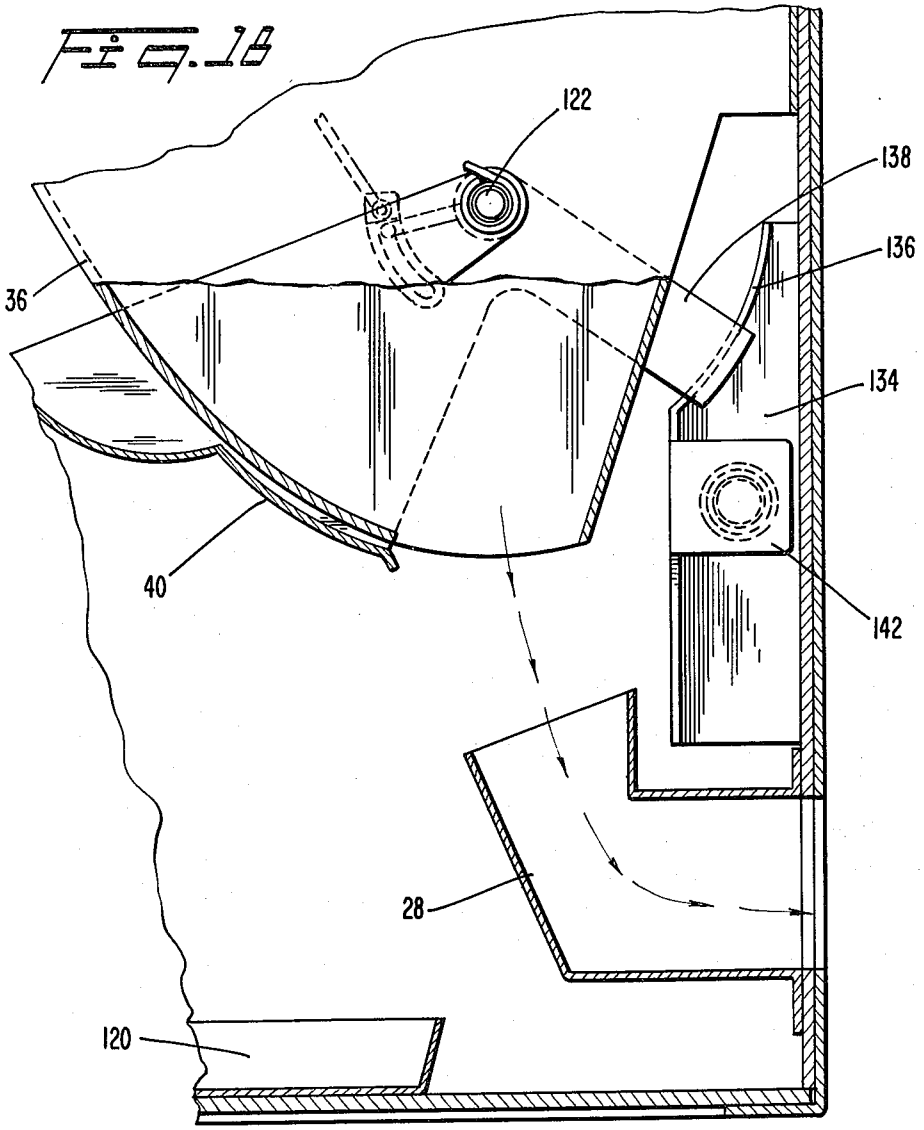
FIG. 18 is a sectional side view similar to FIG. 17 illustrating the distributor door in the reject position to place coins in a return chute.

If, prior to depositing the number of coins sufficient to actuate the electromagnet 70, the consumer decides not to purchase a vended article, the distributor door 40 can be rotated in a clockwise direction, as viewed in FIG. 18, to enable any coins which have been deposited to be returned to the consumer. To accomplish this function, a coin return cam bracket 134 is located within the housing 16 on the side of the distributor door opposite the side on which the latch mechanism is located (see FIG. 2). The bracket is illustrated in detail in FIG. 16, and includes an inclined, arcuate cam surface 136 which engages a camming arm 138 on the distributor door. The bracket also includes an aperature 140 to accommodate the coin return push button 26, and a plate 142 opposing the aperature 140 and against which the push button 26 abuts. A tension spring 144 disposed around the push button 26 maintains the cam bracket 134 in a normal position illustrated in FIG. 2.

By pushing the coin return push button 26, the operator causes the coin return cam bracket to move to the right as viewed in FIG. 2. This movement of the cam bracket causes the distributor door to be rotated in a clockwise direction, as viewed in FIG. 18, under the influence the cam surface 136 has upon the camming projection 138 of the door. Rotation of the distributor door 40 in this direction will cause the deposited coins resting thereon to fall into the coin return chute 28, and be returned to the consumer, as illustrated in FIG. 18.

When deposited coins have been returned to the consumer, the counters, or other storage mechanisms of the electronic circuitry, must be reset to zero, to thereby avoid any error in operation of the latch mechanism when coins are subsequently deposited to make another purchase. For this purpose, the distributor door 40 includes an outwardly projecting flange 146 on the side thereof adjacent the latch mechanism (FIG. 2). The latch lock 82 includes an outwardly projecting flange 148 mounted on the rear portion thereof. The latch lock flange 148 is disposed so as to be engaged by the distributor door flange 146 when the distributor door is rotated in the direction to deposit coins in the coin return chute. Referring to FIG. 6, the distributor door flange 146 will rotate in a counterclockwise direction and engage the underside of the latch lock flange 148 during rotation of the distributor door. Continued rotation of the distributor door after the two flanges are engaged will cause the latch lock 82 to pivot in a clockwise direction against the bias of the spring 84. This rotation of the latch lock 82 will cause the end thereof which abuts the actuator bar 72 to move in a generally downward and rightward direction, due to the location of this end of the latch lock relative to the pivot pin 90. The rightward movement of the end of the latch lock will cause the actuator bar 72 to be pivoted in a counterclockwise direction about its pivot axis 74. The actuator bar 72 pivots by an amount sufficient to cause the microswitch 116 to be tripped by the arm 112 of the bar. As noted previously, actuation of the microswitch 116 causes the storage components of the electric circuitry for controlling the electromagnet to be reset to zero, so that the total number of coins necessary to arrive at the purchase price will again have to be deposited before the latch mechanism is actuated.

Figure 19:
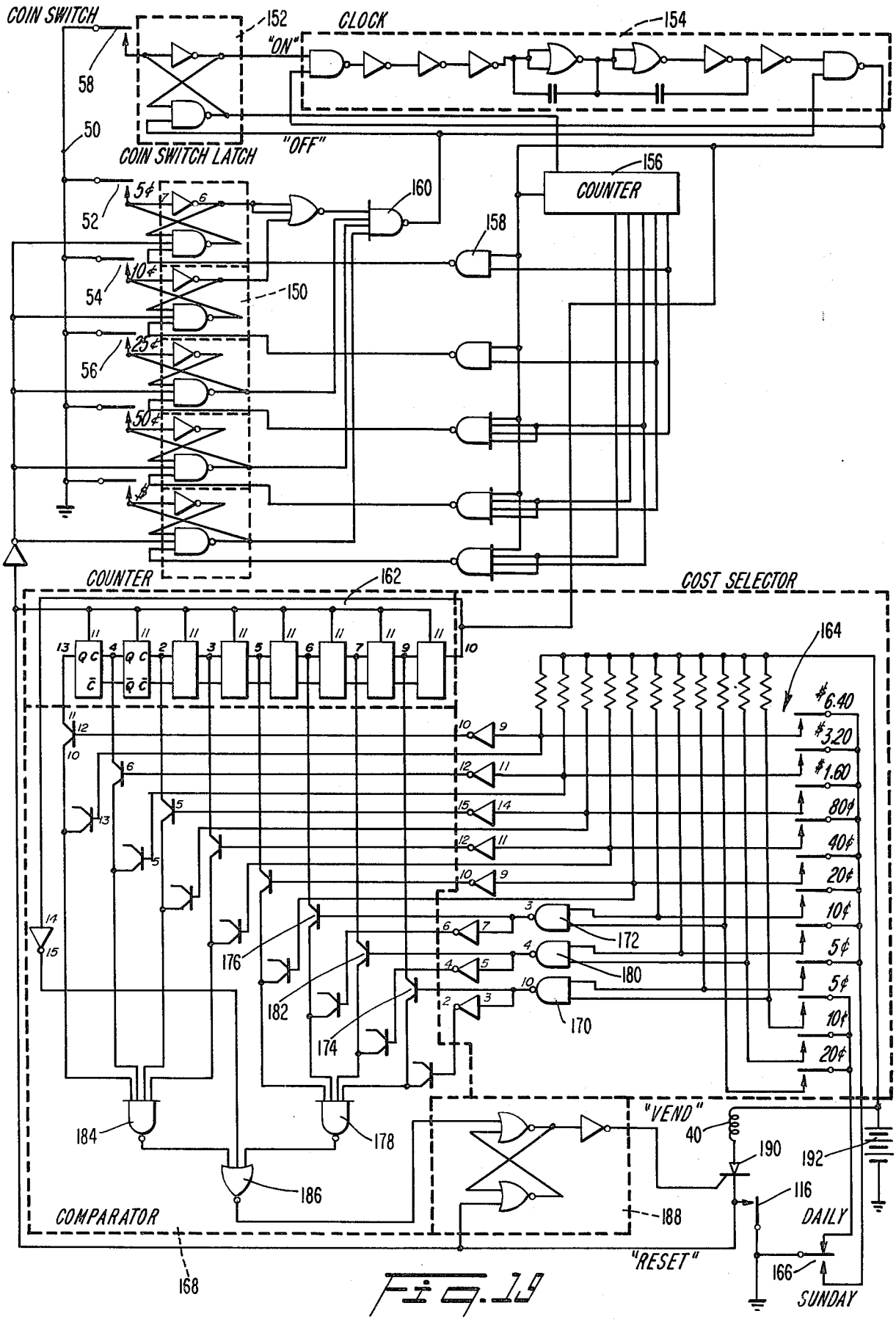
FIG. 19 is a schematic circuit diagram illustrating an electronic circuit that can be utilized in the context of the present invention to detect various coin values and provide a latch actuating signal.

One example of an electronic circuit which can be used in the context of the present invention to store the value of deposited coins and actuate the electromagnet when a sufficient number of coins have been deposited is schematically illustrated in FIG. 19. Each of the coin denomination detecting switches formed by the contacts 50–56 in the coin detecting section of the coin chute 30 is connected to a coin switch latch 150. In addition, the indicating switch formed by the contact 58 is connected to a coin switch latch 152. One output terminal of the latch 152 is connected to an enabling input terminal of a clock 154. When a coin of any denomination is deposited in the coin chute, it closes the contacts 50 and 58 to send a signal to the latch 152, and the latch produces an output signal which turns the clock 154 on. The clock pulses produced by the clock 154 are presented to a first counter 156. When the deposited coin is detected by one of the coin detecting contacts 52 to 56, the latch 150 associated with that contact will be set to produce an output signal indicating that a coin of a particular value has been detected. The output terminals of the counter 156 are appropriately connected to the input terminals of a plurality of NAND gates 158. The output terminals of the gates 158 are respectively connected to reset input terminals of the latches 150.

By way of example, if each clock pulse is designated to represent a monetary value of five cents, the NAND gate 158 associated with the five-cent latch 150 can be connected to the digital "one" output terminal of the counter 156. If a nickel had been deposited in the coin chute and detected, the five-cent latch 150 would be set. After one clock pulse has been counted by the counter 156, the NAND gate 158 associated with the five-cent latch 150 will produce an output signal which will reset the latch. The change in level of the output signal of the latch upon resetting of the latch will be transmitted to a NAND gate 160 which produces a reset signal that causes the latch 152 to terminate operation of the clock 154.

The clock pulses produced by the clock 154 are also supplied to a second counter 162. Therefore, the one pulse which was counted by the counter 156 will also have been counted by the counter 162. Upon turning the clock 154 off, the latch 152 also produces a reset signal which resets the counter 156 to zero. The output signal which is produced by the NAND gate 160 can also be supplied to an inhibit terminal of the clock 154, to thereby prevent any clock pulses which may be travelling through the clock from being presented to either of the counters 156 or 162 after the set latch 150 has been reset.

If, however, a quarter, rather than a nickel, has been deposited and detected, the latch 150 associated with the 25-cent coin detecting contact 56 will be set. Therefore, the output signal produced by the first NAND gate 158 associated with the 5-cent latch 150 will not have any effect upon the operation of the clock when the first clock pulse is counted in the counter 156. Rather, the clock 154 will continue to operate until five clock pulses have been counted by the counter. At this point, the NAND gate 158 associated with the 25-cent latch, which is connected to the digital "one" and "four" output terminals of the counter 156, will produce an output signal which resets the 25-cent latch 150. The change in the output signal level of this latch will likewise cause the NAND gate 160 to produce a reset signal that is supplied to the coin switch latch 152 to turn the clock off, and reset the counter 156. The five clock pulses, representative of the fact that a quarter has been detected, are also counted in the counter 162.

In contrast to the operation of the counter 156, the counter 162 is not reset after the monetary value for a detected coin is counted. Rather, the contents of the counter 162 is representative of the total value of all coins which have been deposited during a purchase transaction.

The price of a vended article is programmed into the electronic control circuit by means of a plurality of price selection switches 164. In the illustrated embodiment, the price selection switches are divided into two groups. One group of switches, comprising three switches respectively labelled "5¢", "10¢" and "20¢", are connected in common to a first contact labelled "DAILY". The second group of price selection switches are connected in common to a second contact labelled "SUNDAY". The appropriate prices for daily and Sunday newspapers, for example, are selected by closing appropriate ones of the price selection switches 164 in each group. The position of a selector switch 166 enables the newspaper carrier to selectively control whether the latch mechanism is to be operated according to the price of daily or Sunday newspapers.

The price determined according to the price selection switches 164 is compared with the contents of the counter 162 in a comparator 168. For example, if the price of a daily paper is 25 cents and the selector switch 166 is in the "DAILY" position, the closed 5-cent and 20-cent price selector switches will supply grounded input signals to each of two NAND gates 170 and 172, respectively. The high level output signals of these two gates will respectively turn on two transistors 174 and 176 in the comparator 168, enabling the output signals appearing on the first and third output terminals of the counter 162 to be applied to a NAND gate 178. However, since the 10-cent switch of the first group of switches remains open, the input signals to both of the terminals of its associated NAND gate 180 are high, and therefore the NAND gate 180 produces a low output signal which renders a transistor 182 in the comparator non-conducting. In addition, the output signal from the NAND gate 180 is inverted and applied to another transistor 184 that is rendered conducting thereby, to supply a high level signal to the input terminal of the NAND gate 178 which is associated with the second output terminal of the counter 162. Therefore, changes in the level of the signal appearing at the second output terminal of the counter 162 will not have any effect upon the output signal of the NAND gate 178.

Prior to the depositing of any coins into the latch mechanism, the signals appearing at all output terminals of the counter 162 will be in a low state. The input signals to the NAND gate 178 will be low, and therefore the output signal from the NAND gate will be high. If a nickel is first deposited into the mechanism, the detection of that coin will cause one clock pulse to be counted in the counter 162, as described previously. Therefore, the signal at the first output terminal of the counter 162 will go high. However, since the signal at the third output terminal of the counter remains low, the output signal of the NAND gate 178 will be unaffected. As more coins are deposited into the mechanism, additional pulses, representative of the values of these coins, will be counted by the counter 162. When the counter has counted five clock pulses, indicative of the fact that at least 25 cents worth of coins has been deposited into the mechanism, both of the signals at the first and third output terminals of the counter will be high. At this point, the output signal of the NAND gate 178 will go low. Since the output signal of another NAND gate 184 in the comparator is also low, due to the fact that the signals appearing on all of its input terminals are high as a result of the open remaining price selector switches 164, the output signal of a NOR gate 186 will go high. The output signal from the NOR gate 186 is supplied to a latch 188 to set the latch.

The setting of the latch 188 produces an output signal which triggers an SCR 190. The SCR is connected in series between the electromagnet 40 and a power supply 192, such as a battery. Triggering of the SCR by the output signal from the latch 188 enables current to flow through the electromagnet 40, thereby release the latch mechanism. Release of the latch mechanism also actuates the switch 116 as described previously, to thereby interrupt the flow of current to the electromagnet 40 and cause a reset signal to be applied to the latch 188 and the counter 162, terminating the triggering signal to the SCR and resetting the contents of the counter to zero, respectively.

It will be appreciated from the foregoing that movement of the selector switch 166 to the "SUNDAY" position causes the circuit to operate in a similar manner in accordance with the programmed price for Sunday newspapers. Furthermore, it will be apparent that the selector switches 164 can be divided up into any appropriate number of groups corresponding to the number of different-priced items to be vended, and that any suitable number of switches can be included in each group to provide an appropriate price range.

Figure 20:
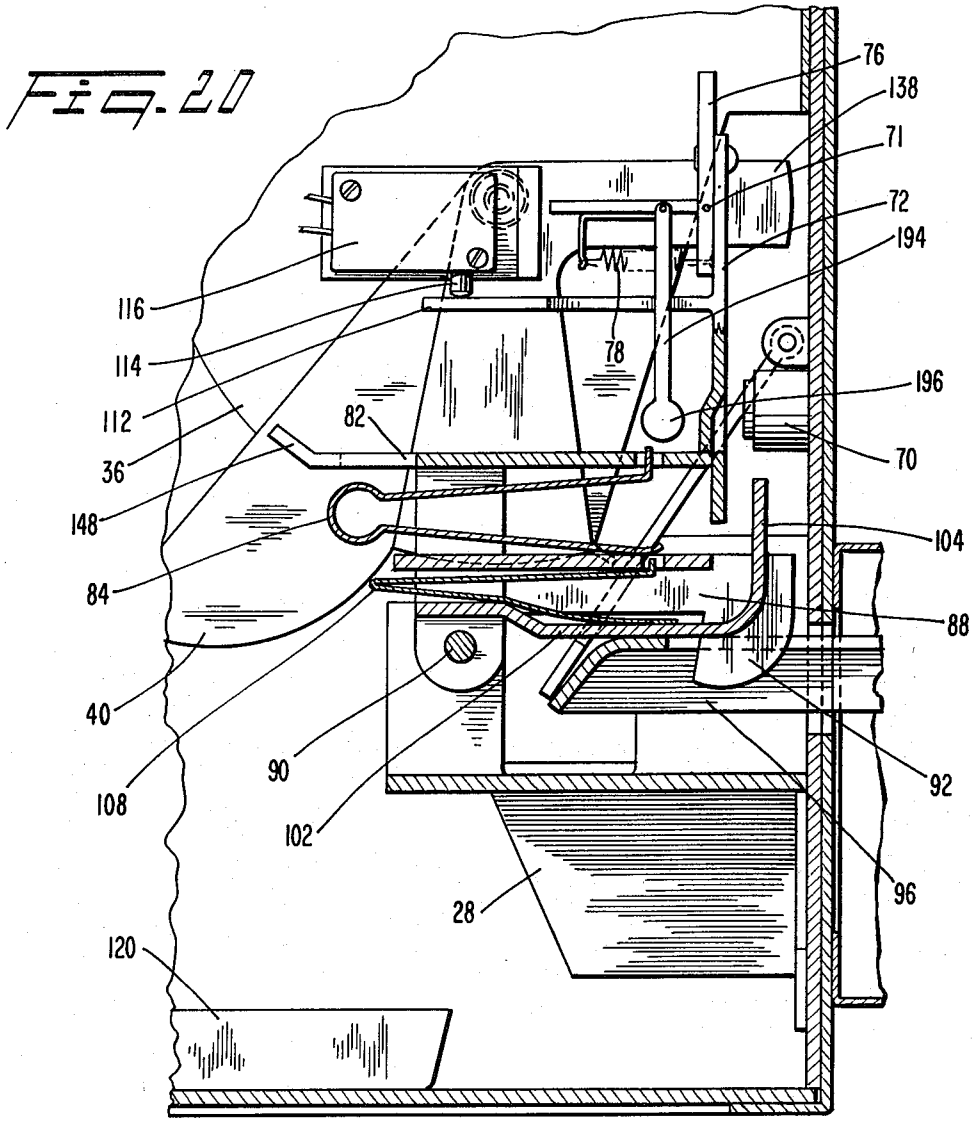
FIG. 20 is a side view similar to FIG. 6 illustrating an alternative embodiment of a latch release mechanism.

An alternative embodiment of apparatus for actuating the latch mechanism is illustrated in FIG. 20. In this embodiment, the electromagnet 70 does not provide the force necessary to pull one end of the actuator arm 72 and thereby pivot the arm. Rather, a pendulum element 194 having a weighted ball 196 at the bottom end thereof is suspended adjacent the actuator bar 72. The electromagnet 70 is mounted on a wall of the latch mechanism housing 16 opposite the ball 196 of the pendulum. Upon actuation of the electromagnet 70, the ball of the pendulum is attracted to the electromagnet and hits the actuator bar 72. The weighted ball 196 is preferably heavy enough and has sufficient inertia so that by the time it hits the actuator bar 72, it imparts sufficient force to move the bar 72 by an amount necessary to release the latch lock 82 from engagement therewith. It may be found that the amount of magnetic attraction necessary to impart sufficient movement to the ball is less than that needed to pivot the actuator bar 72 in the embodiment illustrated in FIGS. 6–8. Therefore, a smaller, and hence less power consuming, electromagnet can be used to thereby extend the life of the power supply.

From the foregoing, it will be appreciated that the present invention provides a novel and desirable coin-operated latch mechanism. Through its use of electronics and electromagnetic actuation of the latch mechanism, the invention overcomes the inherent drawbacks of purely mechanical latch mechanisms. The generation and counting of pulses indicative of the value of deposited coins enables the mechanism to be actuated by depositing any of the various combinations of coins which can make up a predetermined monetary amount. Furthermore, the selection and changing of product prices can be easily accomplished merely by closing and opening price selection switches, rather than the heretofore cumbersome requirement of changing mechanical pawls or entire coin-operated mechanisms. The latch mechanism structure itself is very sturdy and capable of withstanding substantial adverse handling of a vending machine without inadvertantly releasing the latch.

The present invention may be embodied in other specific forms without departing from the spirit or essential characteristics thereof. The presently disclosed embodiments are therefore considered in all respects as illustrative and not restrictive. The scope of the invention is indicated by the appended claims rather than the foregoing description, and all changes which come within the meaning and range of equivalency of the claims are therefore intended to be embraced therein.

What is claimed is:

1. A coin-operated, electronically controlled latch mechanism, comprising:

coin receiving means including a coin chute and a coin receptable for receiving deposited coins passing through said chute;

coin value detecting means disposed in said chute and responsive to the passing of a deposited coin through said chute to generate an electrical signal indicative of the monetary value of a deposited coin;

an electronic control circuit including means for receiving the electrical signals generated by said detecting means and means for producing an output signal when the total monetary value of deposited coins equals or exceeds a predetermined amount;

an electromagnetic device actuated by the output signal of said electronic control circuit;

a latch member; and a latching assembly including a pivotally mounted actuator having a locking means and adapted to be pivoted in response to actuation of said electromagnetic device, a pivotally mounted latch lock normally engaged by the locking means of said actuator, a latch hook biased into engagement with said latch member by said latch lock when said latch lock is engaged by said actuator locking means, and biasing means for pivoting said latch lock away from said actuator and biasing said latch hook out of engagement with said latch member when said actuator is pivoted in response to actuation of said electromagnetic device.

2. The latch mechanism of claim 1 wherein the interior side walls of said coin chute are inclined with respect to vertical so that a deposited coin passes through said coin chute on an incline, and the lower one of said walls includes stepped portions disposed with respect to each other so that coins of different diameters pass through said coin chute at different angles of inclination; and wherein said coin value detecting means includes a plurality of switches having contacts respectively disposed on said stepped portions so that each contact is respectively responsive to the passage of a coin of only one diameter through said coin chute.

3. The latch mechanism of claim 2 further including a common contact disposed in said chute in a position to be engaged by each coin passing through said chute, wherein a deposited coin forms an electrical connection between said common contact and one of said switch contacts to generate an electrical signal.

4. The latch mechanism of claim 1 wherein said coin receiving means includes a movable member disposed intermediate said coin chute and said coin receptacle for interrupting the travel of deposited coins from said chute to said receptacle, said movable member being responsive to movement of said latch member to enable deposited coins to pass into said coin receptacle.

5. A coin-operated, electronically controlled latch mechanism, comprising:

coin receiving means including a coin chute, a coin receptacle for receiving deposited coins passing through said chute, a movable member disposed intermediate said coin chute and said coin receptacle for interrupting the travel of deposited coins from said chute to said receptacle and being movable in a first direction in response to movement of said latch member to direct deposited coins along a first path of travel to said coin receptacle, and means for moving said movable member in a second direction to direct deposited coins along a second path of travel whereby they are returned to a customer;

coin value detecting means disposed in said chute and responsive to the passing of a deposited coin through said chute to generate an electrical signal indicative of the monetary value of a deposited coin;

an electronic control circuit including means for receiving the electrical signals generated by said detecting means and means for producing an output signal when the total monetary value of deposited coins equals or exceeds a predetermined amount;

an electromagnetic device actuated by the output signal of said electronic control circuit;

a latch member; and a latching assembly normally biased into engagement with said latch member to inhibit substantial movement of said latch member, and responsive to actuation of said electromagnetic device to disengage from said latch member to permit freedom of movement thereof.

6. The latch mechanism of claim 5 further including means responsive to movement of said movable member in said second direction for enlarging the size of at least a portion of said coin chute.

7. The latch mechanism of claim 6 wherein the side walls of said coin chute are pivotally mounted with respect to one another, and said enlarging means includes a linkage mechanism responsive to movement of said movable member in said second direction to pivot the side walls away from each other and thereby open said coin chute.

8. The latch mechanism of claim 5 wherein said movable member is pivotally mounted and biased to pivot in said first direction, said member being inhibited from moving in said first direction by said latch member when said latch member is in a latched position.

9. The latch mechanism of claim 8 wherein said moving means includes a cam member for pivoting said blocking member in said second direction against the force of said bias.

10. The latch mechanism of claim 8 further including a pivotable actuator disposed intermediate said movable member and said latch member and adapted to move with said latch member to remove the inhibition to movement of the blocking member when the latch member is moved from a latched position.

11. The latch mechanism of claim 1 further including a biasing arm responsive to the latch member to assume a first position when the latch member is in a latching position and to assume a second position when the latch member is removed from the latching position, and wherein said biasing means includes a spring disposed between said biasing arm and one of said latch lock and said latch hook such that said biasing means urges said latch lock away from said actuator when said biasing arm is in said first position and enables said latch hook to return to a position to be engaged by said locking means when said biasing arm is in said second position.

12. The latch mechanism of claim 11 wherein said biasing means is disposed between said biasing arm and said latch hook, and further including a second spring disposed between said latch hook and said latch lock.

13. The latch mechanism of claim 11 wherein said latch lock, said latch hook and said biasing arm are pivotally mounted about the same pivot axis.

14. Apparatus for detecting the monetary value of different coins deposited into a single coin-receiving chute, comprising:

inclined side walls in the coin-receiving chute that impart angular orientation with respect to vertical to coins passing through the chute;

a plurality of steps disposed on one of said side walls and disposed with respect to each other so that coins of different diameters pass through the chute at different angular orientations; and switch contacts respectively disposed on at least some of said steps so that each contact is responsive to the passage of a coin of only one diameter through the chute.

15. The apparatus of claim 14 further including a common electrical contact disposed in said chute in a position to be engaged by each coin passing through said chute, wherein a deposited coin forms an electrical connection between said common contact and one of said switch contacts to generate an electrical signal.

16. A coin-operated, electronically controlled latch mechanism, comprising:

a coin chute having interior side walls that are inclined with respect to vertical so that a deposited coin passes through said coin chute on an incline, with a lower one of said walls including stepped portions disposed with respect to each other so that coins of different diameters pass through said coin chute at different angles of inclination;

coin value detecting means including a plurality of switches having contacts respectively disposed on said stepped portions so that each contact is respectively responsive to the passage of a coin of only one diameter through said coin chute to generate an electrical signal indicative of the monetary value of a deposited coin;

an electronic control circuit including means for receiving the electrical signals generated by said detecting means and means for producing an output signal when the total monetary value of deposited coins equals or exceeds a predetermined amount;

an electromagnetic device actuated by the output signal of said electronic control circuit;

a latch member; and a latching assembly normally biased into engagement with said latch member to inhibit substantial movement of said latch member, and responsive to actuation of said electromagnetic device to disengage from said latch member to permit freedom of movement thereof.

17. The latch mechanism of claim 16 further including a common contact disposed in said chute in a position to be engaged by each coin passing through said chute, wherein a deposited coin forms an electrical connection between said common contact and one of said switch contacts to generate an electrical signal.

18. The apparatus of claim 14 wherein said plurality of steps are provided along the same portion of said one side wall at different respective distances from the bottom of said wall so that coins of different diameters pass along said portion at different respective angular orientations.

19. The apparatus of claim 16 wherein said stepped portions are provided along the same section of said lower wall at different respective distances from the bottom of said wall so that coins of different diameters pass through said section at different respective angular orientations.

* * * * *